United States Patent [19]

Richard

[11] 4,026,738

[45] May 31, 1977

[54] STABILIZED, FOAMED WATER GEL EXPLOSIVES AND METHOD

[75] Inventor: Jean Paul Richard, St. Bruno, Canada

[73] Assignee: Canadian Industries, Ltd., Montreal, Canada

[22] Filed: Apr. 19, 1976

[21] Appl. No.: 678,222

[30] Foreign Application Priority Data

May 8, 1975 United Kingdom ..... 19381/75

[52] U.S. Cl. ..... 149/44; 149/41; 149/42; 149/60; 149/61; 149/2

[51] Int. Cl.[2] ..... C06B 33/02

[58] Field of Search ..... 149/2, 41, 46, 42, 60, 149/61, 44

[56] References Cited

UNITED STATES PATENTS 3,471,346 10/1969 Lyerly ..... 149/88 X

*Primary Examiner*—Stephen J. Lechert, Jr.
*Attorney, Agent, or Firm*—Donald G. Ballantyne

[57] ABSTRACT

A foamed or aerated water gel explosive composition devoid of any self-explosive sensitizer is provided which is sensitive to detonation in charge diameters greater than 5.1 cm. The explosive composition retains sensitivity for long periods. The migration or collapse of air or gas entrained in the composition is substantially prevented by incorporating a blend of a foaming surfactant and a stabilizing surfactant in chosen proportions.

7 Claims, No Drawings

STABILIZED, FOAMED WATER GEL EXPLOSIVES AND METHOD

In applicant's copending U.S.A. application Ser. No. 547,474 filed on Feb. 6, 1975 and based on Canadian priority application No. 193,099, filed on Feb. 21, 1974, there is disclosed an aerated or foamed water-gel explosive composition comprising water, inorganic oxygen salt, a thickener, a thickener crosslinker, a water-soluble organic nitrate sensitizer, entrapped gas bubbles and a gas bubble stabilizer which stabilizer comprises a blend of a foaming surfactant and a stabilizing surfactant. The disclosed composition, utilizing the well known fact that gas bubbles in gelled, liquid based explosive mixture increases explosive sensitivity, results in a composition sensitive to blasting cap initiation for long periods of time in small diameter cartridges, that is, in cartridges 5.1 cm in diameter or less.

It has now been found that a water-gel explosive composition similar to that disclosed in United States application Ser. No. 547,474 but devoid of any water-soluble organic nitrate sensitizer or other explosive sensitizer can be made which is sensitive to detonation in diameters greater than 5.1 cm. The explosive composition of the present invention comprises water, at least one inorganic oxygen-supplying salt, a thickener, a thickener crosslinker, entrapped gas bubbles and a gas bubble stabilizer which stabilizer comprises a combination of a foaming surfactant and a stabilizing surfactant. The presence of the gas bubble stabilizer retains the entrapped gas bubbles within the composition, prevents their migration, agglomeration or dissipation and thus imparts useful sensitivity properties to the explosive mixture in the complete absence of any self-explosive or other known sensitizers.

The composition of the invention may be packed in film-wrapped or paper-wrapped cartridges of a diameter greater than 5.1 cm or may be bulk-loaded, for example, by means of a pump and hose, into boreholes greater than 5.1 cm diameter.

Exemplary of the foaming surfactant/stabilizing surfactant combinations useful in the present invention are the following:

A. Stabilizing surfactants selected from the group consisting of long chain ($C_{12} - C_{22}$) aliphatic alcohols combined with foaming surfactants compatible therewith selected from the group consisting of metal alkyl sulfates, salts of sulfated alcohols and their ethoxylated derivatives such as triethanolamine lauryl sulfate, sodium lauryl sulfate, ethoxylated ammonium lauryl sulfate and the like, N-acylated amino-sulfonic acids and their salts such as sodium N-methyl-N-coconut acid taurate, sodium N-methyl-N-palmitoyl taurate and the like, imidazoline derivates such as 2-coco-1-(ethyl-$\beta$-oxipropanoic acid)-imidazoline and salts of alkyl sulfonic acid betaines such as lauryl ammonium sulfonic acid betaine and the like.

B. Stabilizing surfactants selected from the group consisting of long chain ($C_{12} - C_{22}$) aliphatic amines and their salts combined with foaming surfactants compatible therewith selected from the group consisting of metal alkyl sulfates, salts of ethoxylated sulfated alcohols such as sodium lauryl sulfate, ethoxylated ammonium lauryl sulfate and the like, N-acylated amino sulphonic acids and their salts such as sodium N-methyl-N-coconut acid taurate, sodium N-methyl-N-palmitoyl taurate and the like and salts of alkyl sulfonic acid betaines as lauryl ammonium sulfonic acid betaine and the like.

C. Glyceryl monoester stabilizing surfactants combined with ethoxylated ammonium lauryl sulfate foaming surfactant.

The primary role of the foaming surfactant rests in the fact that it is capable of foaming the aqueous salt solution of the composition. The stabilizing surfactant cannot foam this salt solution and its surface activity when used alone is usually insignificant because of its poor solubility in this solution. It is postulated that when blended with the foaming surfactant, the stabilizing surfactant's function is to become concentrated at the surface of the film bubble and to complex with the foaming surfactant forming a stable film. The preferred combination of stabilizing surfactant and foaming surfactant comprise ethoxylated ammonium lauryl sulfate with either stearyl alcohol, stearyl, behenyl or arachidyl amines or mixtures of these. The blended surfactant mix may contain from 0.4 parts by weight of active ingredient foaming surfactant to 1 part by weight of active ingredient stabilizing surfactant up to 6.5 parts by weight of active ingredient foaming surfactant to 1 part by weight of active ingredient stabilizing surfactant. Preferably about 4 parts of the active foaming surfactant ingredient is employed for each part of active stabilizing surfactant. From about 0.1 to about 10 parts by weight of foaming surfactant/stabilizing surfactant combination is employed per 100 parts of explosive mixture. The foamed or aerated explosive compositions of the invention are characterized by a dispersion therein of small size gaseous bubbles which resist migration, coalescence, breakdown or dissipation even after prolonged periods of storage.

It has been additionally observed that increased air or gas bubble stability occurs when the hydrophobic chain length of the stabilizing surfactant is equal to or greater than the hydrophobic chain length of the foaming surfactant. It has also been observed that in the environment of an aqueous solution of inorganic oxygen supplying salts, the foaming ability of the foaming surfactant component of the blend decreases with increasing hydrophobic chain length. Preferably, therefore, chain lengths of the foaming surfactant will be selected which are close to 12 carbon atoms and appropriate stabilizing surfactant whose chain length equals or exceeds 12 carbons or whose composition consists of an admixture of chain lengths of 12 or more carbon atoms will be blended therewith.

A suitable inorganic oxygen-supplying salt of the composition of the invention is preferably ammonium nitrate. In some cases it is advantageous to replace some, suitably up to 50% or even as much as 90% of the ammonium nitrate by other metal nitrates such as sodium, barium, potassium and calcium nitrate. The particle size of the oxygen-supplying salt is not critical and prilled or grained forms may be used and part of the salts may be predissolved in all or part of the water.

Suitable thickener components of the explosive compositions of the invention include those compounds capable of thickening the inorganic oxygen-supplying salt solutions, which compounds are known in the art. Particularly preferred are the modified quar gums such as hydroxyethyl modified guar, for example, "Gengel" E-9 (Registered Trade Mark) and hydroxypropyl modified guar, for example, "Jaguar" HP-1 (Registered Trade Mark). Any conventional cross-linker system can be used in the compositions, the preferred system being a mixture of zinc chromate and potassium pyroantimonate.

Optional additional materials may be incorporated in the explosive compositions of the invention and in particular these are materials which have a beneficial effect in further improving either density, stability or strength of the compositions and in the case of cartridged products, rheology modifiers and extrusion aids. Typical materials found to have such effects comprise, for example, ammonium, sodium and potassium perchlorate, particulate metal fuels such as aluminium, silicon and the like, heavier metals known in the art as densifiers such as ferro-silicon, ferrophosphorus, ferrous sulphide and the like, crystal habit modifiers such as alkyl aryl sulfonic acids and the like, and absorbents or drying and bulking materials such as wood pulp and the like. These optional additional materials may occupy up to 20% by weight of the composition.

Any process which will ensure the dispersion of the foaming surfactant and the stabilizing surfactant combination on a molecular level can be used in preparing the explosive compositions of the invention. Since success of the invention relies upon achieving an intimate dispersion of foaming surfactant and stabilizing surfactant, the preferred process embodies preheating the foaming surfactant and stabilizing surfactant together to form a paste and incorporating the paste as an ingredient in the explosive mix, which mix comprises in organic oxidizer salts in amounts, by weight, up to 75%, water in amounts up to 20%, thickeners from 0.4 to 2.0%, cross-linkers from 0.02 to 2.0% and optional additives from 0 to 20%. Air is entrained into the explosive mix by mechanical agitation until a desired density is reached. Air may also be entrained by the addition of some of the dry ingredients at a late stage of the mixing process or by conventional chemical gasing well known in the art. The explosive may then be packaged by extrusion into plastic film or paper cartridges or may be bulk loaded directly into boreholes.

The following Table shows six water-gel explosive compositions devoid of any explosive sensitizer. Mixes 1–4 contain foaming surfactant/stabilizing surfactant combinations. Mixes 5 and 6 contain a foaming surfactant but are devoid of the stabilizing surfactant. It will be observed from the Table that Mixes 5 and 6 failed to detonate under the test conditions.

TABLE

| Mix No. | 1 | 2 | 3 | 4 | 5 | 6 |
|---|---|---|---|---|---|---|
| Ammonium Nitrate | 58.3 | 79.6 | 72.1 | 66.7 | 72.4 | 71.6 |
| Sodium Nitrate | 15.0 | — | 8.0 | — | 8.0 | 8.0 |
| Zinc Nitrate | 0.2 | 0.2 | 0.2 | 0.22 | 0.2 | 0.2 |
| Calcium Nitrate | — | — | — | 10.0 | — | — |
| Ethylene Glycol | — | — | 5.0 | 5.0 | 5.0 | 5.0 |
| Aluminium (Fuel) | 5.0 | 3.0 | — | 5.0 | — | — |
| Gilsonite | — | 3.5 | 2.98 | 1.71 | 3.0 | 3.0 |
| Guar Gum | 0.6 | 0.6 | 0.6 | 0.6 | 0.6 | 0.6 |
| Crosslinker | 0.06 | 0.06 | 0.06 | 0.06 | 0.06 | 0.06 |
| $Zn\ CrO_4$ | 0.5 | 0.5 | 0.05 | — | — | — |
| Sulfur | 7.81 | — | — | — | — | — |
| Water | 12.0 | 12.0 | 10.0 | 10.0 | 10.0 | 10.0 |
| Foaming Surfactant* | 0.47 (1) | 0.47 (1) | 0.77 (1) | 0.54 (1) | 0.77 (1) | 1.5 (3) |
| Stabilizing Surfactant* | 0.05 (2) | 0.05 (2) | 0.23 (2) | 0.16 (2) | — | — |
| Fumaric Acid | — | — | — | — | 0.02 | 0.02 |
| Cartridge Diameter cm | 12.7 | 10.16 | 7.62 | 5.1 | 7.62 | 7.62 |
| Density as made | 1.00 | 1.20 | 1.06 | 1.12 | 1.07 | 1.10 |
| after storage | — | — | 1.07 (1 day) | — | — | — |
| Sensitivity GR Pentolite | 20 GR 46° F Detonates | 160 GR 40° F Detonates | 20 GR 70° F Detonates | 40 GR 70° F Detonates | 80 GR 60° F Fails | 160 GR 60° F Fails |

*% weight of commercial product
(1) Ethoxylated ammonium lauryl sulfate
(2) Mixed stearyl and behenyl amines
(3) Ammonium lauryl sulfate The composition of the invention, therefore, provides an explosive mixture detonable in diameters greater than 5.1 cm yet particularly safe to manufacture and use due to the absence of any dangerous explosive sensitizing ingredient.

What we claim is:

1. A thickened and cross-linked, foamed, water-bearing explosive composition devoid of any self-explosive sensitizer and detonable in diameters greater than 5.1 cm comprising essentially water, at least one inorganic oxygen-supplying salt, a thickener cross-linker and entrapped gas bubbles, the said composition also containing a gas bubble stabilizer, which stabilizer comprises a combination of a foaming surfactant and a stabilizing surfactant and which gas bubble stabilizer is present in a quantity of between 0.1% and 10% by weight of the total explosive composition.

2. An explosive composition as claimed in claim 1 wherein the foaming surfactant/stabilizer surfactant combinations are selected from:

A. Stabilizing surfactants selected from the group consisting of long chain ($C_{12}$ – $C_{22}$) aliphatic alcohols combined with foaming surfactants compatible therewith selected from the group consisting of metal alkyl sulfates, salts of sulfated alcohols and their ethoxylated derivatives such as triethanolamine lauryl sulfate, sodium lauryl sulfate, ethoxylated ammonium lauryl sulfate and the like, N-acylated amino-sulfonic acids and their salts such as sodium N-methyl-N-coconut acid taurate, sodium N-methyl-N-palmitoyl taurate and the like, imidazoline derivatives such as 2-coco-1-(ethyl-$\beta$-oxipropanoic acid)-imidazoline and salts of alkyl sulfonic acid betaines such as lauryl ammonium sulfonic acid betaine and the like.

B. Stabilizing surfactants selected from the group consisting of long chain ($C_{12}$ – $C_{22}$) aliphatic amines and their salts combined with foaming surfactants compatible therewith selected from the group consisting of metal alkyl sulfates, salts of ethoxylated sulfated alchohols such as sodium lauryl sulfate, ethoxylated ammonium lauryl sulfate and the like, N-acylated amino sulphonic acids and their salts such as sodium N-methyl-N-coconut acid taurate, sodium N-methyl-N-palmitoyl taurate and the like and salts of alkyl sulfonic acid betaines such as lauryl ammonium sulfonic acid betaine and the like.

C. Glyceryl monoester stabilizing surfactants combined with ethoxylated ammonium lauryl sulfate foaming surfactant.

3. An explosive composition as claimed in claim 2 wherein the hydropholic chain length of the stabilizing surfactant is equal to or greater than the hydrophobic chain length of the foaming surfactant.

4. An explosive composition as claimed in claim 3 wherein the chain length of the foaming surfactant is 12 carbon atoms and the chain length of the stabilizing surfactant is 12 or more carbon atoms.

5. A thickened and cross-linked, foamed, water-bearing explosive composition comprising from about 50% to 80% by weight of inorganic oxygen-supplying salt, from about 5% to 20% by weight of water, from 0.4% to 2% by weight of thickener, from 0.02% to 2% by weight of cross-linker, entrapped gas bubbles and from 0.1% to 10% by weight of foaming surfactant/stabilizing surfactant combination in the ratio of from 0.4 parts by weight of active ingredient of foaming surfactant to 1 part by weight of active ingredient of stabilizing surfactant up to 6.5 parts by weight of active ingredient of foaming surfactant to 1 part by weight of active ingredient of stabilizing surfactant.

6. An explosive composition as claimed in claim 5 also containing up to 20% by weight of optional additives selected from fuel ingredients comprising aluminium, gilsonite and silicon, sensitizing ingredients comprising inorganic perchlorates, density control ingredients comprising ferro-silicon, ferrophosphorus and ferrous sulphide, crystal habit modifiers comprising alkyl aryl sulphonic acids, and absorbents, drying and bulking materials.

7. A process for the manufacture of a stabilized, thickened, cross-linked and foamed water-bearing explosive composition devoid of any self-explosive sensitizer and detonable in diameter greater than 5.1 cm. which comprises the steps of combining together under the influence of heat a stabilizing surfactant and a foaming surfactant to form a combination product of paste-like consistency and thereafter adding between 0.1% and 10% by weight of said paste-like combination product to an explosive composition comprising water, inorganic oxygen-supplying salt, thickener and thickener cross-linker.

* * * * *